US009737094B1

(12) United States Patent
Roeder

(10) Patent No.: US 9,737,094 B1
(45) Date of Patent: Aug. 22, 2017

(54) POCKET SQUARE JEWELED CAP AND BASE

(71) Applicant: Steven Paul Roeder, North Hollywood, CA (US)

(72) Inventor: Steven Paul Roeder, North Hollywood, CA (US)

(73) Assignee: Steven Paul Roeder, Sr., N. Hollywood, CA (US)

( * ) Notice: Subject to any disclaimer, the term of this patent is extended or adjusted under 35 U.S.C. 154(b) by 0 days.

(21) Appl. No.: 15/162,280

(22) Filed: May 23, 2016

(51) Int. Cl.
*A41B 15/00* (2006.01)
*A41B 15/02* (2006.01)

(52) U.S. Cl.
CPC ..... *A41B 15/02* (2013.01)

(58) Field of Classification Search
CPC ..... A41B 15/02; A41B 15/00; A44C 1/00
USPC ..... 2/279
See application file for complete search history.

(56) References Cited

U.S. PATENT DOCUMENTS 2,738,515 A * 3/1956 Owen ..... A41B 15/02 2/279
3,280,488 A * 10/1966 Rubin ..... G09F 3/00 2/249
3,786,520 A * 1/1974 Harmon ..... A41B 15/02 2/279
4,165,621 A * 8/1979 Gould ..... A44C 1/00 24/13
5,231,702 A * 8/1993 Masters ..... A41B 15/02 2/244
7,854,021 B2 * 12/2010 Compton ..... G09F 21/02 2/243.1
8,418,267 B2 * 4/2013 Shaw ..... A41D 27/08 2/247
2009/0260395 A1 * 10/2009 Coleman ..... A44C 1/00 63/20

* cited by examiner

*Primary Examiner* — Khoa Huynh
*Assistant Examiner* — Timothy K Trieu

(57) ABSTRACT

The Pocket Square Jeweled Cap And Base is an article of jewelry comprised substantially of a thin cap made of or plated with semi precious or precious metal, enamel, wood, crystal, sterling silver stained glass, gold, platinum, ebony, pearls or ceramic. Inside the metal cap is substantially a metal male protruding nub snap component. Affixed to the caps are substantially semi precious or precious stones, optional small time piece, enamel, wood, crystal, sterling silver, stained glass, gold, platinum, ebony or ceramic. Inserted into and snapped to the bottom opening of the decorated cap is a thin, brittle, flexible, elongated rectangular, pocketed or un pocketed triple stitched base component. Affixed to the upper base component is a male metal protruding nub snap which is then attached, snapped to the inside of the caps metal female snap receptacle creating a single ornament. The ornament is inserted into a coat outer breast pocket exposing one third to one fourth of the upper decorated metal cap above the top edge of the pocket.

1 Claim, 4 Drawing Sheets

POCKET SQUARE JEWELED CAP AND BASE

The Pocket Square Jeweled Cap And Base is a interchangeable, outer coat, pocket supported article of jewelry. It is comprised of a narrow, thin, substantially concave, rectangular metal cap component in similar configured designs as a folded cotton or silk handkerchief. The metal cap is decorated with affixed jewels and or a small time piece. A metal female snap receptacle element is affixed to the inside of the metal cap. The cap receives inside its bottom opening, an elongated, rectangular, brittle, flexible support piece of approximately the same width as the metal cap and depth of the pocket. The support component is affixed with a male nub snap element allowing the two components to be snapped together. The back of the metal cap is primarily exposed to enable one to push with ones thumb, the back of the outer portion of the support piece affixed with the female receiving snap element into the metal cap inner male nub snap receptacle element. The completed, combined, attached ornament is then inserted into the outer upper breast pocket of a suit or sport jacket. The jeweled, and or time piece portion of the cap is positioned in view approximately one third to one forth above the top ridge of the pocket while the snap connected support piece is hidden out of view inside the pocket.

CROSS-REFERENCE TO RELATED APPLICATIONS

Patents that show the closest known illustrations are cited as follows. U.S. Pat. No. 20,090,260,395-Pocket Square Brooch, an article of jewelry with overlapped triangular leafs in which a scatter pin attaches the brooch to the pocket fabric. Problem: Pinned jewelry on suit coats cause material damage by making holes. Brooches also are loose fitting subject to catching and pulling causing further damage to the fabric of the suit pocket and or the suit itself. Brooches are subject to pricking ones fingers causing bleeding and possible infection while applying. U.S. Pat. No. 2,5134,884—Ornament Simulated Handkerchief, a pocket insert with a flattened tube of stiff material worn in the breast pocket. U.S. Pat. No. 5,231,702—A reusable article of apparel for decorating pockets, a pocket unit that can be used alone or with decorative fabrics. U.S. Pat. No. 3,786,520—Simulated Pocket Ornament and Holder, a pocket insert. U.S. Pat. No. 4,422,306—Garment attachment including openable enclosure. Problem: The pin attaching elements with this patent are subject to the same dangerous pricking injury. infection and fabric damage of the Brooch Patent. The Pocket Square Jeweled Cap And Base Piece is a safe, non-damaging, jeweled and or time pieced interchangeable breast pocket display piece allowing the mixing and matching of different caps to different support pieces according to the colors and styles of suits and or ties.

STATEMENT REGARDING FEDERALLY SPONSORED RESEARCH OR DEVELOPMENT

Not Applicable

NAMES OF PARTIES TO JOINT RESEARCH AGREEMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

My Invention relates generally to an artistically folded cloth or silk handkerchief or pocket square that it used by placing it down into an outer, upper breast pocket displaying in view approximately one half to one fourth of the handkerchief. More so it pertains to a pocket square of a suit or sport jacket simulating an elevated view. It also pertains to time pieces traditionally placed on a band fitting over the wrist or on a chain inserted into a vest pocket.

Illustrations and prior art that best replicates the invention are patents: U.S. Pat. No. 2,090,260,395, U.S. Pat. No. 134,884, U.S. Pat. No. 5,231,702, U.S. Pat. No. 3,786,520, U.S. Pat. No. 4,422,306. These patents referenced relates to my invention as a pocket insert which is not supported by scatter pins and clutches, composing of interchangeable, jeweled, time piece decorated metal caps that are snap attached to brittle, flexible, rectangular, pocketed, elongated support bases. The caps and support bases can also be one single affixed ornament. Both decorated caps and support bases can be of different colors, pocket square folded configurations and mix and matched for cost effective choice of fashionable accessory combinations. Other referenced replications include, U.S. Pat. No. 2,507,049, U.S. Pat. No. 2,508,535, U.S. Pat. No. 3,513,154, U.S. Pat. No. 2,592,033, U.S. Pat. No. 2,697,838, U.S. Pat. No. 2,738,515, U.S. Pat. No. 3,215,268, U.S. Pat. No. 20,090,260,395.

SUMMARY OF THE INVENTION

The Pocket Square Jeweled Cap And Base is a jeweled, interchangeable coat outer breast pocket display piece consisting of a thin, rectangular concave shaped metal cap of optional sizes made of semi-precious, precious or plated metal. The cap is affixed substantially with decorated semi-precious or precious jewels, stones, pearls, and or a small time piece on the upper third outside front portion of the cap. Inserted into the lower cap opening is a longer, thin rectangular brittle but pliable support base with minutely smaller dimensions of a suit breast inner pocket. The Pocket Square Jeweled Cap and Base is thin, concave in shape and light weight eliminating this problem. For a smaller man, the width of the chest pocket is 3-3.5 inches/7.6-8.9 centimeters. For a larger man the width of the chest pocket on a coat or jacket is 0.5-5 inches/11.4-12.7 centimeters. The Pocket Square Jeweled Cap and Base is slightly narrower to allow it to slide into the coat outer breast pocket. Within the support base is an elongated pocket. The pocket can store money, credit cards, key or other thin objects. The support base is then attached to the cap by means of metal snaps in which the male snap element is lazed on to the lower inside portion of the cap and the female element of the snap is pressured and stamped into the upper inner portion of the support base enabling the mating of the cap and support piece by snapping the two components together. The ability for one to interchange components of the invention is desirable in mix and match alternatives according to fashion trends, matching attire and individual mood swings. The caps can be configured in the same pocket square folded configurations now made of cotton or silk. Properly cared for metal caps can be everlasting. The caps can be engraved, enameled, embossed or colored for sports licensing, corporate logos, names, any premium incentive gift products. The caps can also be suited for family heirlooms and personal jewelry attachments and then placed close to one's heart therefor enhancing sentimentality. The small optional affixed or detachable time piece lends notice to the entire unit as the viewer will focus on it.

All prior art shows limitations and in view of the possible dangerous applications and longevity of the existing art, The Pocket Square Jeweled Cap And Base provides a solution for sturdy placement and the safe, secure fastening of a decorated, fashionable, jeweled, interchangeable breast pocket display piece. The snapping of metal to nonmetal surfaces is not common place with other known decorative jeweled products. The back of the metal cap is primarily exposed to enable one to push the back of the support piece male snap element with the thumb into the inner portion of the metal cap female receiving snap element held in the other hand marrying the two components together. The concave shape of the metal cap forces the pliable support base also into a concave shape when inserted and snapped together. It is simple to construct as the caps are pressure stamped substantially from rolls of predetermined thicknesses and widths of stainless steel. The lengths of sheet steel are pushed through a conveyor belt into a steel mold and pressure stamped and cut by a heavy duty steel block press into the desired configuration. The stamped cap is ejected and then machine polished so the edges are not sharp and the cap is smooth and shining with a mirror like glaze. It can also be plated, dipped or lined in precious metal or other metals and can be coated with various precious metals including gold, sterling silver, or platinum. The support base can be of leather, denim, vinyl, plastic, aluminum or other light weight flexible materials. The snapping of the two components, cap and support base is safe, convenient and fast. Other connecting materials such as hook and loop Velcro and magnetic strips can also attach the metal cap to the support base. The inner pocket of the support base allows storage for thin personal items and or a small smudge wiping cloth. The Pocket Square Jeweled Cap And Base can be used by one unskilled in the artistic art of folding a cloth handkerchief. Light weight, non-bulky and sparkling reflections from light angles, the invention lends itself to an upscale user wanting extra notice and attention. It will lend itself substantially but not limited to news and sports casters, awards ceremonies, special events, tuxedo rental stores, clothing stores, department and jewelry stores. A trade name to be used will be "ROYLCHIF". Most items placed in the breast pocket create lumpy projections which distort the sleek appearance of the suit and the breast pocket and the inside left pocket share the same space in the jacket's lining, meaning that objects in the breast pocket tend to force items in the inside pocket into the wearer's ribs, which is quite uncomfortable. The brooch and pinned ornaments mentioned in prior art are cumbersome, dangerous and fabric damaging. They are common place in women's fashion. Pocket squares have been traditionally constructed of cotton or silk fabric which needs laundering and continuing forming and reforming before and after insertion into the coat breast Pocket. The life of the cloth is limited and there is a need for repurchasing. Constant attention is needed to keep configurations of the pocket square in place.

While in the outer breast pocket, an unsightly bulge is formed with all pocket square configurations. The Pocket Square Jeweled Cap And Base can be constructed in various colors and sizes of the light weight metalized caps. The caps allow for jeweled and time pieced component configurations and as well as the base piece being constructed of various light weight and permeable materials, colors, snap shapes and sizes. The invention is pocket supported by means of the lower portion of the metal cap forced outward from the snap protrusion and base piece protrusion made by the adjoining snaps when attached together. The lower part of the metal plate presses against the inner pocket of the coat outer breast pocket preventing the slippage.

As outlined in the foregoing and in general, the physical aspects of the invention serves as a better understanding the more detailed description of the invention which follows below. There should be an understanding that the present invention is not limited to methods or details of its construction, materials, construction methods, fabrication, or application of use described and illustrated. Other methods of the construction and fabrication should be considered apparent as an alternative embodiment of the invention, elongated, rectangular, pocketed or un pocketed support base component.

BRIEF DESCRIPTION OF THE SEVERAL VIEWS OF THE DRAWINGS

FIG. 1 12 is a cap
FIG. 1 13 is a jewel
FIG. 1 14 is the upper ledge of the pocket
FIG. 2 15 is the upper ledge of the cap
FIG. 2 16 is a small time piece
FIG. 2 17 is the cap securing tab inserting into 24
FIG. 2 18 is the front view of the support base
FIG. 2 19 is the inner pocket of the support base
FIG. 2 20 is the stitching around the support base
FIG. 3 21 is the upper rear portion of the cap
FIG. 3 22 is the rear view of the support base
FIG. 6 23 is the front support base male metal snap nub
FIG. 6 24 is the front support base supporting slot receiving 17
FIG. 7 25 is the metal female receiving snap cap
FIG. 7 26 is inside of cap
FIG. 7 27 is a gap approximately ⅛ inch between front and back of cap
FIG. 8 side view referenced in FIG. 2
FIG. 8 28 gap between cap and support base forced by the progression of larger snaps
FIG. 9 29 cash in pocket
FIG. 9 30 credit cards in center pocket
FIG. 10 31 second stitching
FIG. 10 32 third stitching

DETAILED DESCRIPTION OF THE INVENTION

Figure 2:
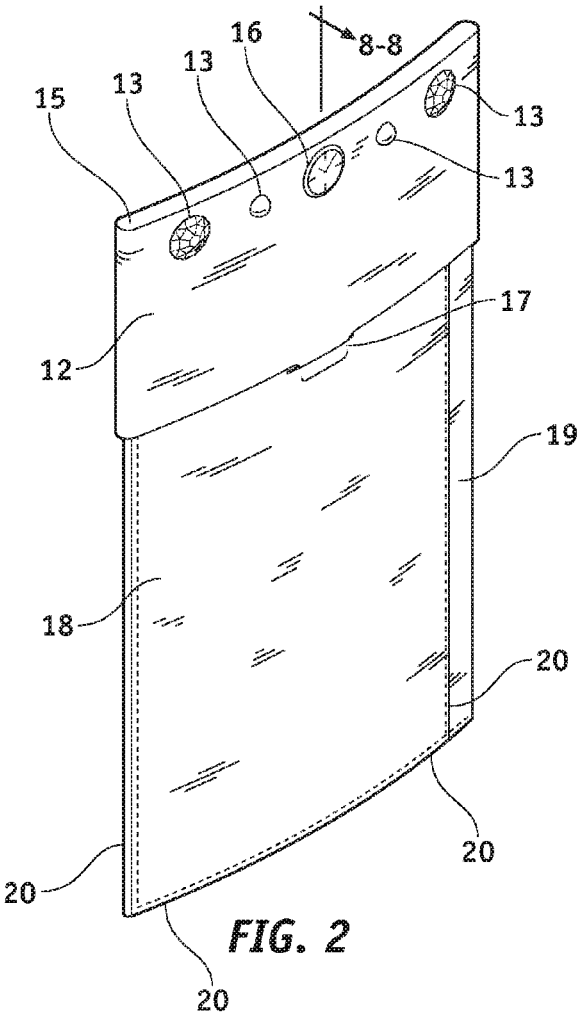
Figure 3:
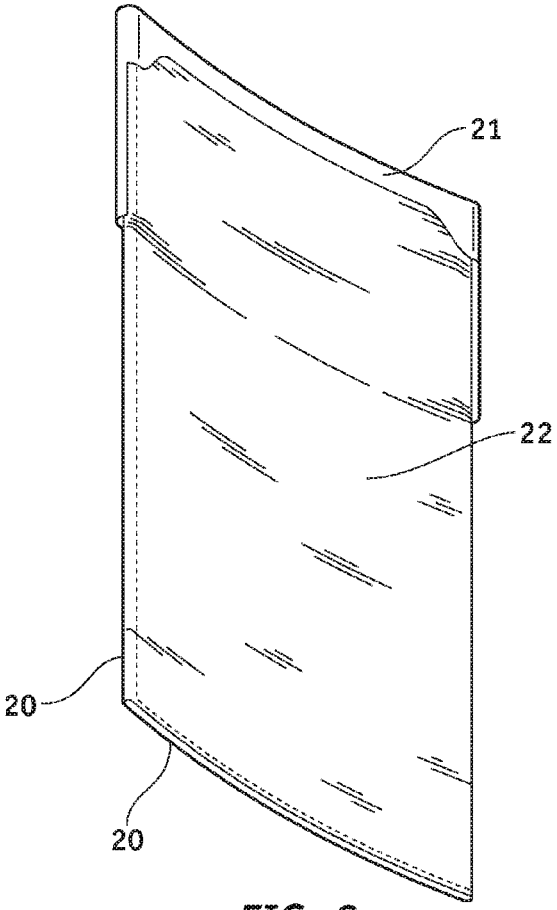
Figure 4:
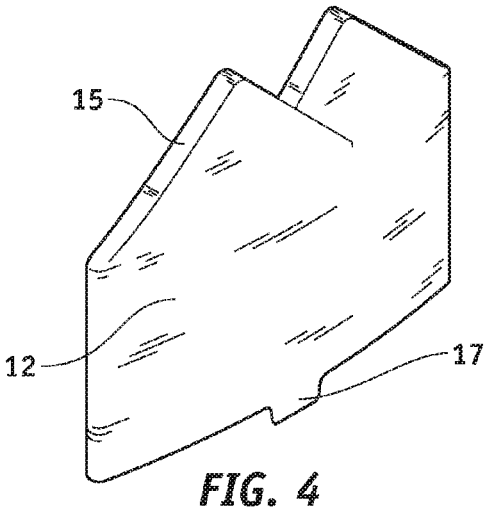
FIG. 4 is an example of an alternative design figure.
Figure 5:
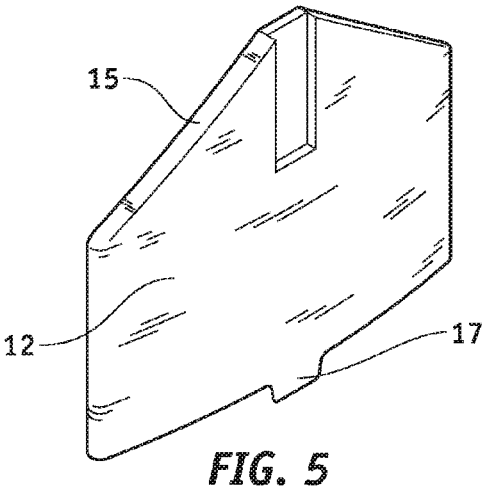
FIG. 5 is a second example of an alternative design figure
Figure 6:
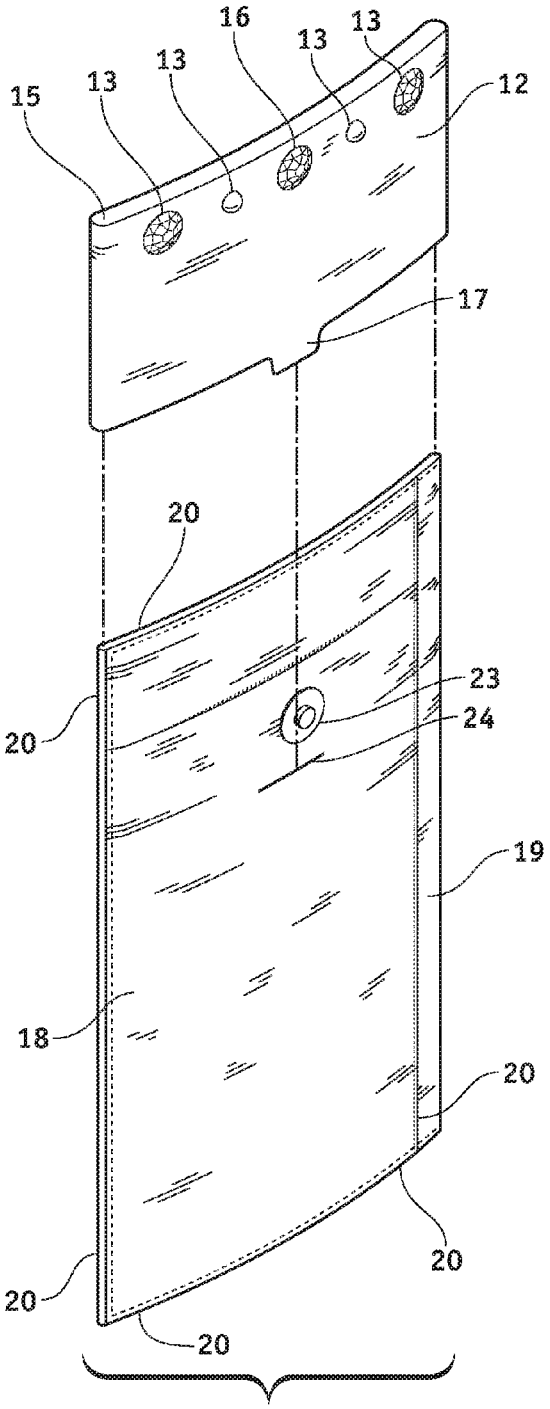
Figure 7:
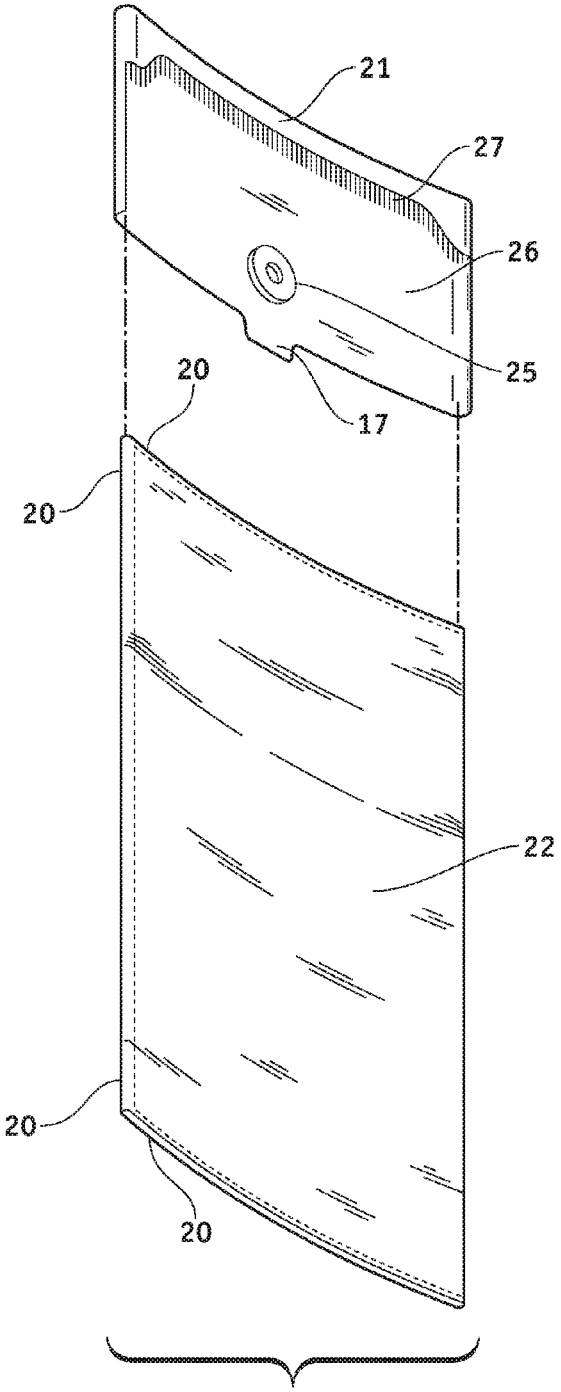

The Pocket Square Jeweled Cap And Base FIG. 2. is an article of jewelry comprised of a precious or semiprecious metal cap 12, affixed with precious or semiprecious Stones 13, and or an optional small time piece 16, relating to the embodiment of the invention in FIG. 2 of the drawings, fashioned to replicate the images of folded cloth or silk handkerchiefs FIG. 4. A female metal receptacle snap component 25, is affixed to the inside portion of the cap 26. A support base 18, compromised substantially of a thin, brittle, flexible, elongated, rectangular, pocketed 19, or un pocketed component with an affixed male metal protruding nub snap 23, which slides up, through the bottom of the metal cap 12, while the male nub snap 23 is pushed into and connected to the female snap receptacle 25, making one ornament. FIG. 2, is the overall invention of a Pocket Square Jeweled Cap And Base. FIG. 2 which is a jewelry piece 13 and time piece 16, made to serve as the alternative to wearing an artistically folded cloth or silk handkerchief or pocket square positioned above the top ledge 14, of an upper outer pocket of a suit jacket. The Pocket Square Jeweled Cap 12 and Base 18 is snap connected and slid into the pocket leaving the upper portion of the jeweled cap 12, facing outward from the pocket for viewing. The invention consists of six components, A Pocket Square Jeweled Metal cap 12, and precious or semiprecious stones 13, an optional small time piece 16, a metal male nub snap 23, and an interchangeable, elongated, brittle, pocketed 19 or un pocketed, triple stitched 20,31.32 side and bottom, adaptable sizing support base 18 with affixed female metal snap receptacle 25.

I claim to have invented a Pocket Square Jeweled Cap And Base embodiment with securing lower tab comprised substantially of but not limited to semiprecious, precious metal and or enamel, wood, crystal, sterling silver, stained glass, gold, platinum, ebony or ceramic. A Pocket Square Jeweled Cap And Base embodiment referring to claim 1, comprised substantially of affixed semiprecious, precious stones, enamel, wood, pearls, crystal, sterling silver, stained glass, gold, platinum, ebony or ceramic. A pocket square jeweled cap and base embodiment referring to claim 1, comprised of an optional small circular time piece. A Pocket Square Jeweled Cap And Base embodiment referring to claim 1, comprised substantially of a female metal snap receptacle and a male metal protruding. A Pocket Square Jeweled Cap And Base embodiment referring to claim 1, compromised substantially of an interchangeable, thin, brittle, flexible, elongated, pocketed or un pocketed support base and female metal snap receptacle and cut slot to receive securing metal cap tab. An inner pocket securing action in which the metal cap inner embodiment female metal snap receptacle component referred to in claim 1. and the outer base piece male metal nub snap receptacle referred to in claim 1, when both male and female snap components are upsized in width and depth and snap connected together, forces the lower portion of the metal cap away from the upper portion of the support base causing a securing action with in the pocket by pushing the lower portion of the cap against the inner lining of the breast pocket holding the finished ornament smug and secure with in the pocket.

Figure 1:
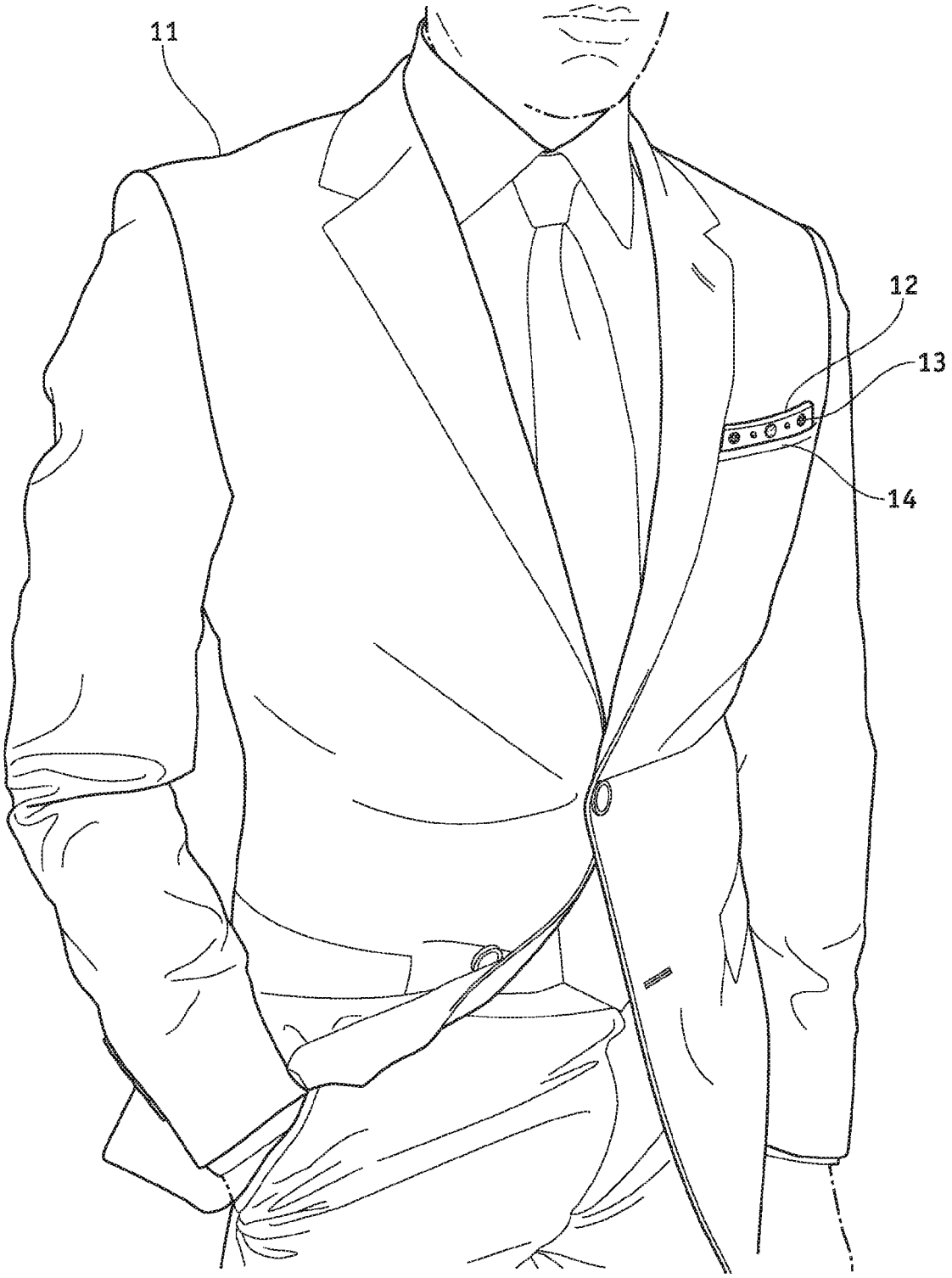
FIG. 1. 11 is the view of a suit coat
Figure 8:
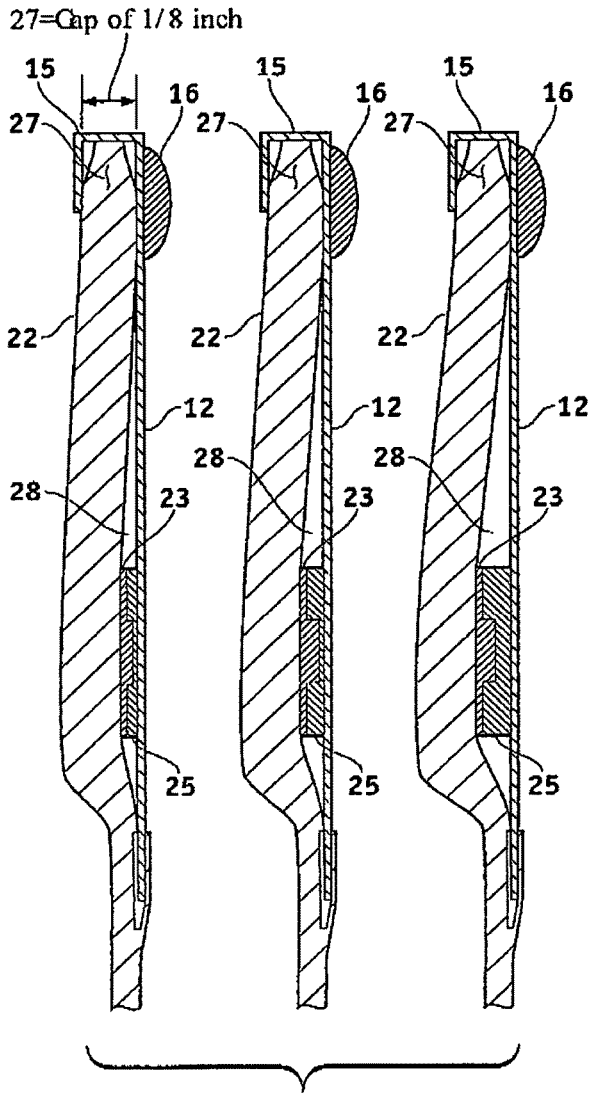
Figure 9:
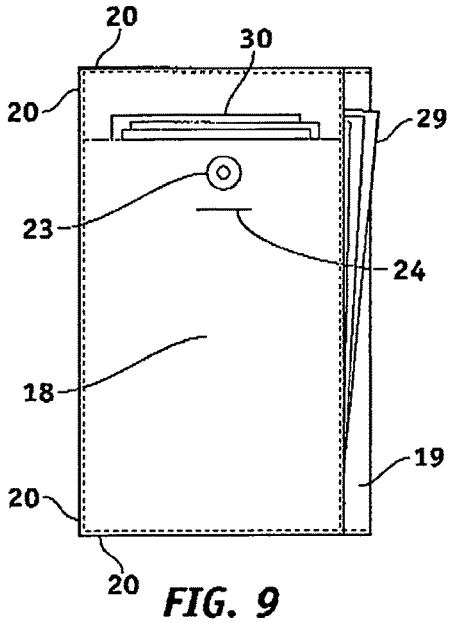
Figure 10:
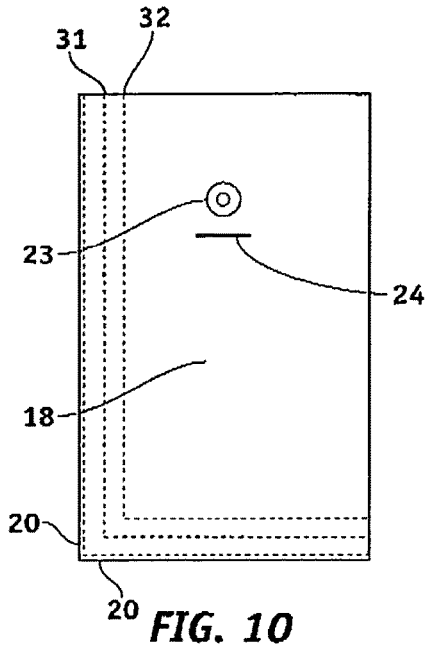

A pocket supported, decorative ornament device comprising of: a base support 18, cap 12; FIG. 1 shows a garment including a pocket 14; Said cap and said support configured to insert into said pocket of said garment; said base support 18 comprises a body panel; said body panel including a front surface, a rear surface an upper edge, lower edge and two vertical sides; said body including a first, second and third stitching lines 20 extending vertically and horizontally, and said body including a vertical pocket 19 and a horizontal pocket 30; said front surface including a first opening for accessing to said horizontal pocket and a second opening for accessing to said vertical pocket; wherein said front surface including a slot 24 and a male snap fastener 23; wherein said male snap fastener position below said horizontal pocket and said male snap fastener position between said horizontal pocket 30 and an opening of said slot 24. FIG. 8 shows wherein said cap 12 including a front surface, a back surface, an upper ledge 15, a bottom ledge, a two side ledges; said upper ledge of said cap comprises an extension extending rearward from said front surface of said cap to form gap 27 approximately ⅛ inch and said extension extending downward from said upper ledge to form a concave shape of said gap; said front surface of said cap including a plurality of decorative ornaments 13, 16 and a protrusion extending downwardly to form a tap 17 is configured to receive by said opening of said slot 24; wherein said back surface 26 of said cap comprises a female snap fastener 25 including a recess is configured to corresponding with a side protrusion of said male snap fastener 23; wherein said upper edge of base support designed to insert into said concave shape of said gap, wherein said protrusion designed to insert into said opening of said slot for locking the support base into said pocket of said garment; and said side protrusion of said male snap fastener designed to insert into said recess of said female fastener to form a space between said back surface of said cap and front surface of said body panel and to fasten said cap 12 onto said base support 18 as after said male and female fasteners snap into each other; wherein said female snap faster comprises a thickness; wherein said thickness including a thicker in thickness designed to increase said space length for holding thicker element; FIG. 1 said base support 18 is configured to be hidden from front view vision when inserted into said pocket which covering by said pocket and said cap. FIG. 8 the female 25 including a first thickness and second thickness; the first thickness is greater/thicker than the second thickness. The first thickness designed for a first space 28 and the second thickness designed for a second space 28.

The invention claimed is:

1. A pocket supported, decorative ornament device comprising a base support and a cap are configured to insert into a pocket of a garment;

said base support comprises a body panel; said body panel including a front surface, a rear surface an upper edge, lower edge and two vertical sides; said body panel including a first, second and third stitching lines extending vertically and horizontally, and said body panel including a vertical pocket and a horizontal pocket; said front surface including a first opening for accessing to said horizontal pocket and a second opening for accessing to said vertical pocket; wherein said front surface including a slot and a male snap fastener; wherein said male snap fastener position below said horizontal pocket and said male snap fastener position between said horizontal pocket and an opening of said slot; wherein said cap including a front surface, a back surface, an upper ledge, a bottom ledge, a two side ledges; said upper ledge of said cap comprises an extension extending rearward from said front surface of said cap to form gap approximately ⅛ inch and said extension extending downward from said upper ledge to form a concave shape of said gap; said front surface of said cap including a plurality of decorative ornaments and a protrusion extending downwardly to form a tap is received by said opening of said slot; wherein said back surface of said cap comprises a female snap fastener including a recess corresponding with a side protrusion of said male snap fastener; wherein said upper edge of base support designed to insert into said concave shape of said gap, wherein said protrusion designed to insert into said opening of said slot for locking the support base into said cap; and said side protrusion of said male snap fastener designed to insert into said recess of said female fastener to form a space between said back surface of said cap and front surface of said body panel and to fasten said cap onto said base support as after said male and female fasteners snap into each other; wherein said female snap faster comprises a first thickness and a second thickness; wherein said first thickness is thicker than the second thickness; wherein said first thickness designed for a first space and the second thickness designed for a second space; wherein said thickness including a thicker in thickness is designed to increase said space for holding thicker element; wherein said base support is configured to be hidden from front view vision when inserted into said pocket of said garment which covering by said pocket and said cap when the garment is being worn.

* * * * *